United States Patent [19]

Minegishi et al.

[11] 4,277,350

[45] Jul. 7, 1981

[54] TEXTILE SOFTENING AGENT

[75] Inventors: Yutaka Minegishi, Miyashiro; Toshiro Nishimura, Wakayama, both of Japan

[73] Assignee: Kao Soap Co., Ltd., Tokyo, Japan

[21] Appl. No.: 98,685

[22] Filed: Nov. 29, 1979

[30] Foreign Application Priority Data

Dec. 5, 1978 [JP] Japan ..... 53-150290

[51] Int. Cl.[3] ..... D06M 13/46; D06M 13/38

[52] U.S. Cl. ..... 252/8.8; 252/528; 252/547; 427/394; 427/396; 260/501.1; 564/295

[58] Field of Search ..... 252/547, 528, 8.8 AS; 427/394, 396; 260/567.6 P, 501.1–501.21

[56] References Cited

U.S. PATENT DOCUMENTS 4,110,263 8/1978 Lindemann et al. ..... 252/547 X

FOREIGN PATENT DOCUMENTS 1261231 1/1972 United Kingdom ..... 252/547

*Primary Examiner*—Mayer Weinblatt

*Attorney, Agent, or Firm*—Oblon, Fisher, Spivak, McClelland & Maier

[57] ABSTRACT

A softening agent comprising a quaternary ammonium salt is effectively useful for garment fabrics made of natural fibers or synthetic fibers.

4 Claims, No Drawings

TEXTILE SOFTENING AGENT

BACKGROUND OF THE INVENTION

1. Field of the Invention

This invention relates to softeners or softening agents for textile finishing. More particularly, the invention relates to a softening agent comprising a quaternary ammonium salt of a specific class.

2. Description of the Prior Art

It has heretofore been known that textile softeners which are used in domestic or home laundering comprise as an essential ingredient a quaternary ammonium salt having in its molecule one or two long-chain alkyl groups. These quaternary-type softeners have the advantage that even when applied in limited amounts, they make it possible to give sufficient softness to natural fibers such as cotton. However, such known quaternary ammonium salts encounter the difficulty that they are not satisfactory for producing softness on synthetic fibers such as acrylics which have recently found wider and better use in the textile industry.

In general, garment fabrics made of synthetic fibers are liable to become gradually stiff during their repeated wearing and washing, and therefore, they require a finishing or softening treatment so as to be rendered suitable for re-wearing without any unpleasant stiffness. In home laundering, almost all kinds of garments are generally washed together in one and the same washing bath. For this reason, a need continues to exist for a textile softening agent capable of affording sufficient softness to both natural fibers and synthetic fibers.

With the above noted difficulties of the existing textile softeners in view, the present inventors have made intensive studies on various softening agents which can satisfactorily impart softness to synthetic fibers, while retaining the same effectiveness or softening action on natural fibers as do conventionally used softeners. In these studies, leading to the invention, it has been found that particular quaternary ammonium salts of formula (I), which will appear hereinafter, achieve the above desired properties and give the best results.

SUMMARY OF THE INVENTION

In accordance with the present invention, there is provided a softening agent for textile finishing comprising as an essential component a quaternary ammonium salt represented by formula (I),

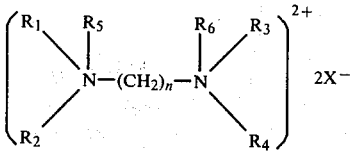

(I)

wherein $R_1$, $R_2$, $R_3$ and $R_4$ each represent an alkyl group having 12 to 22 carbon atoms, $R_5$ and $R_6$ each represent an alkyl group having 1 to 3 carbon atoms, X represents a halogen atom or a monoalkyl sulfate group containing an alkyl group having 1 to 3 carbon atoms and n is an integer of 4 to 8.

It is an object of the invention to provide a softening agent which surmounts the shortcomings of the conventional textile softeners.

A more specific object of the invention is to provide a softening agent which comprises a quaternary ammonium salt of formula (I) as an essential component and which is highly effective in imparting softness or soft hand not only to natural fibers but also to synthetic fibers.

Other objects and advantages of this invention will become apparent from the following description.

DETAILED DESCRIPTION OF THE PREFERRED EMBODIMENTS

Quaternary ammonium salts of formula (I) which are useful in the practice of the present invention can be produced, for example, by process 1 or 2 in combination with process 3, all of which are described below. Process 1 or 2 comprises preparing tertiary amines as starting materials, while process 3 comprises converting the thus prepared tertiary amines to the respective quaternary ammonium salts in the presence of suitable converting agents and alkali agents.

Process 1

Into an autoclave are charged 1 mole of a polymethylene diamine having 4 to 8 carbon atoms, 4 to 6 moles of an alkyl chloride having 12 to 22 carbon atoms, and 4 to 6 moles of sodium hydroxide as an aqueous solution containing about 15 to 20% by weight thereof. The reaction is conducted over a period of about 15 to 25 hours at a temperature of 150° to 210° C. until the theoretical tertiary amine value comes up to 85% or more. After being separated from the aqueous layer, the oily layer is washed with water and heated under a reduced pressure of less than 10 mmHg to remove unreacted alkyl chloride using topping apparatus, thereby obtaining a tertiary amine.

Process 2

Into an autoclave are charged 1 mole of a polymethylene dichloride having 4 to 8 carbon atoms, 2 to 2.5 moles of a dialkyl amine containing two alkyl groups each having 12 to 22 carbon atoms, and 2 to 2.2 moles of sodium hydroxide as an aqueous solution containing about 20% by weight thereof. The reaction is conducted over a period of about 7 to 13 hours at a temperature of 150° to 210° C. until the theoretical tertiary amine value comes up to 85% or more. After being separated from the aqueous layer, the oily layer is washed with water, thereby obtaining a tertiary amine.

Process 3

Into an autoclave are charged 1 mole of the tertiary amine prepared by process 1 or 2 above, 2 to 3 moles of a converting agent, 0 to 1.4 times of an alkali agent equivalent to an excess of the converting agent, 20 to 100% of isopropyl alcohol based on the weight of the tertiary amine, and 0 to 10% of water based on the weight of the tertiary amine. The reaction is carried out over a period of 5 to 7 hours at a temperature of 40° to 120° C. to yield the desired quaternary ammonium salt.

Typical examples of polymethylene diamines having 4 to 8 carbon atoms which are useful in process 1 above include tetramethylene diamine, hexamethylene diamine, octamethylene diamine and the like. Typical examples of alkyl chlorides having 12 to 22 carbon atoms include lauryl chloride, myristyl chloride, cetyl chloride, stearyl chloride, eicosyl chloride, docosyl chloride, hydrogenated coconut alkyl chloride, hydrogenated palm alkyl chloride, hydrogenated tallow alkyl chloride and the like. Typical examples of polymethylene dichlorides having 4 to 8 carbon atoms which are useful in process 2 above include tetramethylene dichloride, hexamethylene dichloride, octamethylene dichloride and the like. Typical examples of dialkyl amines containing two alkyl groups each having 12 to 22 carbon atoms include dilauryl amine, dimyristyl amine, dicetyl amine, distearyl amine, dieicosyl amine, didocosyl amine, di(hydrogenated coconut alkyl)amine, di(hydrogenated palm alkyl)amine, di(hydrogenated tallow alkyl) amine and the like. Furthermore, typical examples of converting agents which are useful in process 3 above include methyl chloride, propyl bromide, dimethyl sulfate, diethyl sulfate, dipropyl sulfate and the like. Typical examples of alkali agents include sodium hydroxide, sodium hydrogencarbonate, sodium carbonate and the like.

In reducing this invention to practice, it is desired that the softening agent be used in the form of a dispersion comprising any selected one quaternary ammonium salt of formula (I) in amounts of 3 to 20% by weight, preferably 3 to 10% by weight. In such instance, any conventional cationic softener may be utilized in combination with the quaternary ammonium salt. However, the amount of the cationic softener varies depending upon the intended function and properties of the softening agent to be actually used.

In order to formulate the softening agent of the invention in its dispersed form described above, a suitable dispersing agent should be added which is selected, for example, from a condensation product of 1 mole of each of a higher alcohol having 10 to 18 carbon atoms, and an alkyl phenol containing an alkyl group having 8 to 12 carbon atoms and 9 to 150 moles of ethylene oxide, dipolyoxyethylene ($\overline{P}=5$ to 100) alkylmethyl ammonium chloride containing an alkyl group having 10 to 18 carbon atoms and the like. An inorganic salt such as sodium chloride, ammonium chloride or the like, a solvent containing 1 to 3 hydroxyl groups each having 1 to 3 carbon atoms such as propylene glycol, ethylene glycol, isopropyl alcohol or the like, and urea may also be employed so that when prepared in dispersed form, the softening agent is conveniently adjusted in its viscosity to a proper degree.

It is important to note that the best mode of practice of the softening agent according to this invention lies in a dispersion comprising a quaternary ammonium salt in amounts of 3 to 20% by weight, a dispersing agent in amounts of 0.2 to 3.0% by weight, a solvent in amounts of 0.05 to 10% by weight, and water in the balance.

Of further importance, n in formula (I) should be an integer of 4 to 8, and preferably, the integer is equal to 6. Use of a quaternary ammonium salt outside this range for n in formula (I) results in impaired softening properties.

Other additives such as a pigment, a dye, an optical brighter and a perfume may be advantageously utilized in any convenient manner to render the softening agent more commercially valuable.

This invention will now be described in more detail with reference to certain specific Examples which are provided for purposes of illustration only and are not intended to be construed as limiting. The following Reference Examples are illustrative of the preparation of the quaternary ammonium salts of formula (I) which are useful in and typical of the practice of the invention.

REFERENCE EXAMPLE I

Into an autoclave were charged 27 g (0.24 mole) of hexamethylene diamine, 404 g (1.40 moles) of stearyl chloride and 236.7 g (1.0 mole) of an aqueous solution containing 16.9% by weight of sodium hydroxide. The mixture was reacted for 20 hours at 175° to 180° C. After completion of the reaction, the oily layer was separated from the aqueous layer and washed with water. Thereafter, the oily layer was heated at 156° to 180° C. under a reduced pressure of 0.2 to 0.25 mmHg to remove unreacted stearyl chloride using a topping apparatus, thereby giving the tertiary amine in a yield of 95%.

Into an autoclave were then charged 200 g (0.178 mole) of the tertiary amine thus prepared, 19.7 g (0.39 mole) of methyl chloride, 2.1 g (0.02 mole) of sodium carbonate, 180 g of isopropyl alcohol and 20 g of water. The mixture was reacted for 6 hours at 105° to 110° C. to obtain the desired quaternary ammonium salt in a yield of approximately 100%.

REFERENCE EXAMPLE II

The same operation as in Reference Example I was repeated, except that the stearyl chloride was replaced by 195 g (0.70 mole) of hydrogenated tallow alkyl chloride, to give the tertiary amine in a yield of 96%. Subsequently, the tertiary amine was likewise reacted to obtain the desired quaternary ammonium salt in a yield of about 100%.

REFERENCE EXAMPLE III

Into an autoclave were charged 28.8 g (0.20 mole) of octamethylene diamine, 164 g (0.80 mole) of lauryl chloride and 94.7 g (0.40 mole) of an aqueous solution containing 16.9% by weight of sodium hydroxide. The mixture was reacted for 16 hours at 150° C. After completion of the reaction, the oily layer was separated from the aqueous layer and washed with water. Thereafter, the oily layer was heated at 120° to 140° C. under a reduced pressure of 4 to 5 mmHg to remove unreacted lauryl chloride using a topping apparatus, thereby giving the tertiary amine in a yield of 90%.

Into an autoclave were then charged 150 g (0.184 mole) of the tertiary amine thus prepared, 46.4 g (0.368 mole) of dimethyl sulfate and 80 g of isopropyl alcohol. The mixture was reacted for 5 hours at 55° to 60° C. to obtain the desired quaternary ammonium salt in a yield of 98%.

REFERENCE EXAMPLE IV

Into an autoclave were charged 133 g (0.21 mole) of didocosyl amine, 12.7 g (0.1 mole) of tetramethylene dichloride and 42 g (0.21 mole) of an aqueous solution containing 20% by weight of sodium hydroxide. The mixture was reacted for 12 hours at 200° to 210° C. After completion of the reaction, the oily layer was separated from the aqueous layer and washed with water, to give the tertiary amine in a yield of 88%.

Into an autoclave were charged 100 g (0.077 mole) of the tertiary amine thus prepared, 8.5 g (0.169 mole) of methyl chloride, 0.72 g (0.018 mole) of sodium hydroxide, 80 g of isopropyl alcohol and 5 g of water. The mixture was reacted for 7 hours at 110° to 120° C. to obtain the desired quaternary ammonium salt in a yield of 95%.

REFERENCE EXAMPLE V

Into an autoclave were charged 312 g (0.60 mole) of distearyl amine, 34.8 g (0.30 mole) of hexamethylene dichloride and 120 g (0.60 mole) of an aqueous solution containing 20% by weight of sodium hydroxide. The mixture was reacted for 12 hours at 180° to 185° C. After completion of the reaction, the oily layer was separated from the aqueous layer and washed with water, to give the tertiary amine in a yield of 93%.

Into an autoclave were then charged 250 g (0.22 mole) of the tertiary amine thus prepared, 68.4 g (0.44 mole) of diethyl sulfate and 140 g of isopropyl alcohol. The mixture was reacted for 6 hours at 60° to 65° C. to obtain the desired quaternary ammonium salt in a yield of 96%.

REFERENCE EXAMPLE VI

Into an autoclave were charged 428 g (1.1 moles) of di(hydrogenated coconu alkyl)amine, 63.5 g (0.5 mole) of tetramethylene dichloride and 210 g (1.05 moles) of an aqueous solution containing 20% by weight of sodium hydroxide. The mixture was reacted for 8 hours at 160° to 170° C. After completion of the reaction, the oily layer was separated from the aqueous layer and washed with water, to give the tertiary amine in a yield of 92%.

Into an autoclave were then charged 300 g (0.36 mole) of the tertiary amine thus prepared, 97 g (0.79 mole) of propyl bromide, 2.8 g (0.07 mole) of sodium hydroxide, 110 g of isopropyl alcohol and 20 g of water. The mixture was reacted for 6 hours at 100° to 110° C. to obtain the desired quaternary ammonium salt in a yield of 94%.

EXAMPLE 1

The effects of the quaternary ammonium salts obtained in Reference Examples I to VI, inclusive, upon fabric softness were observed and graded with the results tabulated in Table 1. As the control, use was made of dialkyldimethyl ammonium chlorides (DADMAC) in which all the alkyl groups are of the same chain length as in Reference Examples I to VI, respectively.

Finishing Treatment-Softness

Commercially available cotton towels and acrylic jersey were each washed five times with a commercially marketed synthetic detergent ["New Beads" (Trade Name) made by Kao Soap Co., Ltd.] until the towels and jersey became relatively stiff. Subsequently, the towels and jersey were each treated in a dispersing liquid having a concentration of 40 ppm of each of the test quaternary ammonium salts under the following conditions: with stirring; temperature, 25° C.; time, 5 minutes; and bath ratio, 1/30.

Determination of Softness

The towels and jersey treated above were dried and then allowed to stand for 24 hours at an ambient temperature of 25° C. and a relative humidity of 65%. The softness of each of the thus treated towels and jersey was determined and graded.

TABLE 1

| Quaternary ammonium salt | Softness | |
|---|---|---|
| | Acrylic jersey | Cotton towel |
| Distearyldimethyl ammonium chloride (control) | 0 | 0 |
| Salt of Reference Example I | +2 | 0 |
| Salt of Reference Example V | +1.5 | 0 |
| Di(hydrogenated tallow alkyl)dimethyl ammonium chloride (control) | 0 | 0 |
| Salt of Reference Example II | +2 | 0 |
| Dilauryldimethyl ammonium chloride (control) | 0 | 0 |
| Salt of Reference Example III | +1 | +0.5 |
| Didocosyldimethyl ammonium chloride (control) | 0 | 0 |
| Salt of Reference Example IV | +1.5 | 0 |
| (Di(hydrogenated coconut alkyl) dimethyl ammonium chloride (control) | 0 | 0 |
| Salt of Reference Example VI | +1 | +0.5 |

Grading Notations of Softness
+2: Softer than the control
+1: Slightly softer than the control
0: Soft equally to the control
−1: Slightly stiffer than the control
−2: Stiffer than the control Table 1 confirms that the quaternary ammonium salts which are useful in the invention impart a higher degree of softness to the acrylic jersey than DADMAC in which all the alkyl groups are of the same chain length. Moreover, in view of the softening effects on the cotton towels, such quaternary ammonium salts are substantially equal to, or better than, the control salts.

EXAMPLE II

Using the same procedure as in Example I, the effects of the number of both the long-chain alkyl groups and the methylene groups in the quaternary ammonium salts upon softness were observed and graded with the results tabulated in Tables 2 and 3.

TABLE 2

(Effect of Number of Alkyl Groups)

| Quaternary ammonium salt | Softness | |
|---|---|---|
| | Acrylic jersey | Cotton towels |
| Salt of Reference Example I | +2 | 0 |
| N, N, N'-Tristearyl-N,N',N'-trimethylhexamethylene diammonium dichloride | 0 | 0 |
| N, N'-Distearyl-N, N, N', N'-tetramethylhexamethylene diammonium dichloride | −1 | −1.5 |
| N, N-Distearyl-N, N', N', N'-tetramethylhexamethylene diammonium dichloride | −1 | −1 |
| N-Stearyl-N, N, N', N', N'-pentamethylhexamethylene diammonium dichloride | −2 | −2 |
| Distearyldimethyl ammonium chloride (control) | 0 | 0 |

Table 2 confirms that the quaternary ammonium salts having an alkyl group number of 3 or less possess reduced softening properties.

TABLE 3

(Effect of Number of Methylene Groups)

| Quaternary ammonium salt | Softness | |
|---|---|---|
| | Acrylic jersey | Cotton towels |
| Salt of Reference Example I | +2 | 0 |
| N,N,N',N'-Tetrastearyl-N,N'-dimethyltrimethylene diammonium dichloride (n = 3) | 0 | 0 |
| N,N,N',N'-Tetrastearyl-N,N'- | | |

TABLE 3-continued (Effect of Number of Methylene Groups)

| Quaternary ammonium salt | Softness: Acrylic jersey | Softness: Cotton towels |
|---|---|---|
| dimethylnonamethylene diammonium dichloride (n = 9) | +1 | −1 |
| Distearyldimethyl ammonium chloride (control) | 0 | 0 |

Table 3 confirms that the quaternary ammonium salts having a methylene group number of 3 or less, or 9 or more are not effective in softness as compared to the control salt or distearyldimethyl ammonium chloride.

EXAMPLE III

| Composition | |
|---|---|
| (1) Quaternary ammonium salt of Reference Example I | 6% |
| (2) Polyoxyethylene ($\overline{P}$ = 25) lauryl ether | 1 |
| (3) Propylene glycol | 5 |
| (4) Perfume and pigment | small amounts |
| (5) Water | Balance |
| | (% by weight) |

Preparation

Polyoxyethylene(P=25)lauryl ether and propylene glycol were added to a given amount of water, and the mixture was heated up to 50° to 60° C. To the mixture was added with stirring the quaternary ammonium salt of Reference Example I which had previously been melted. After sufficient dispersion of the ammonium salt in the mixture, a perfume and a pigment were added to the resulting dispersion which was then cooled to room temperature to obtain a softener.

EXAMPLE IV

The same operation as in Example III was repeated, except that the quaternary ammonium salt was replaced by that of Reference Example II, to obtain a softener.

EXAMPLE V

| Composition | |
|---|---|
| (1) Quaternary ammonium salt of Reference Example III | 15% |
| (2) Polyoxyethylene ($\overline{P}$ = 100) oleyl ether | 2 |
| (3) Urea | 5 |
| (4) Ammonium chloride | 0.5 |
| (5) Perfume and pigment | small amounts |
| (6) Water | Balance |
| | (% by weight) |

Preparation

Using the same operation as in Example III, a softener was obtained.

EXAMPLE VI

| Composition | |
|---|---|
| (1) Quaternary ammonium salt of Reference Example IV | 4% |
| (2) Polyoxyethylene ($\overline{P}$ = 50) nonylphenyl ether | 0.5 |
| (3) Ethylene glycol | 3 |

-continued

| Composition | |
|---|---|
| (4) Perfume and pigment | small amounts |
| (5) Water | Balance |
| | (% by weight) |

Preparation

Using the same operation as in Example III, a softener was obtained.

EXAMPLE VII

| Composition | |
|---|---|
| (1) Quaternary ammonium salt of Reference Example V | 5% |
| (2) Polyoxyethylene ($\overline{P}$ = 10) oleyl ether | 0.8 |
| (3) Sodium chloride | 0.05 |
| (4) Perfume and pigment | small amounts |
| (5) Water | Balance |
| | (% by weight) |

Preparation

Using the same operation as in Example III, a softener was obtained.

EXAMPLE VIII

| Composition | |
|---|---|
| (1) Quaternary ammonium salt of Reference Example VI | 10% |
| (2) Polyoxyethyelen ($\overline{P}$ = 70) stearyl ether | 1 |
| (3) Propylene glycol | 4 |
| (4) Sodium chloride | 0.02 |
| (5) Perfume and pigment | small amounts |
| (6) Water | Balance |
| | (% by weight) |

Preparation

Using the same operation as in Example III, a softener was obtained.

What is claimed as new and desired to be secured by Letters Patent of the United States is:

1. A softening agent for textile finishing comprising as an essential component 3–20% by weight of a quaternary ammonium salt represented by the formula,

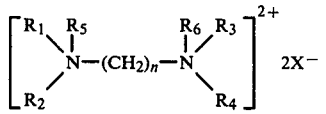

wherein $R_1$, $R_2$, $R_3$ and $R_4$ each represent an alkyl group having 12 to 22 atoms, $R_5$ and $R_6$ each represent an alkyl group having 1 to 3 carbon atoms, X represents a halogen atom or a monoalkyl sulfate group containing an alkyl group having 1 to 3 carbon atoms, and n is an integer of 4 to 8.

2. The softening agent of claim 1, wherein said integer for n in the formula is 6.

3. The softening agent of claim 1, wherein said quaternary ammonium salt is present in an amount of 3 to 10% by weight.

4. The softening agent of claim 1, further comprising a dispersing agent whereby the softening agent is in the form of a dispersion wherein said dispersing agent is present in an amount of 0.2 to 3.0% by wt.

* * * * *